US007136021B2

(12) United States Patent
Huang et al.

(10) Patent No.: US 7,136,021 B2
(45) Date of Patent: Nov. 14, 2006

(54) CERAMIC CHIP ANTENNA

(75) Inventors: Yuh Hui Huang, Taoyuan (TW); Ching Shu Fang, Taoyuan (TW)

(73) Assignee: Cirex Technology Corporation, Taoyuan (TW)

( * ) Notice: Subject to any disclaimer, the term of this patent is extended or adjusted under 35 U.S.C. 154(b) by 0 days.

(21) Appl. No.: 11/034,012

(22) Filed: Jan. 13, 2005

(65) Prior Publication Data

US 2006/0152415 A1 Jul. 13, 2006

(51) Int. Cl.
*H01Q 1/38* (2006.01)

(52) U.S. Cl. ..... 343/702; 343/895

(58) Field of Classification Search ..... 343/702, 343/700 MS, 895, 873
See application file for complete search history.

(56) References Cited

U.S. PATENT DOCUMENTS 5,277,723 A * 1/1994 Kodama et al. ..... 156/89.15
5,456,778 A * 10/1995 Fukuta et al. ..... 156/89.17
6,139,666 A * 10/2000 Fasano et al. ..... 156/85
6,452,548 B1 * 9/2002 Nagumo et al. ..... 343/700 MS
6,567,049 B1 * 5/2003 Huang et al. ..... 343/700 MS
2003/0011532 A1 * 1/2003 Yoshinomoto et al. ..... 343/895
2004/0108967 A1 * 6/2004 Fujimura et al. ..... 343/895

FOREIGN PATENT DOCUMENTS

| | | |
|---|---|---|
| TW | 513827 | 12/2002 |
| TW | 518801 | 1/2003 |
| TW | 543939 | 7/2003 |
| TW | 2000414604 | 8/2004 |

* cited by examiner

*Primary Examiner*—Trinh Dinh
*Assistant Examiner*—Huedung Mancuso

(57) ABSTRACT

A ceramic chip antenna for transmitting and receiving wireless signals. The antenna includes a substrate and a conductor. The substrate is made of sintered ceramic material with a low dielectric loss and a high dielectric constant. A pair of concavities is cut from both longitudinal ends of the substrate. The conductor is made of metal with a high Q factor as well as a good anti-oxidization property, being formed on surfaces of the substrate by means of mask etching or printing technology. The conductor has a circuit portion disposed on surfaces of the substrate in a meandered or helical manner, and two conducting electrodes disposed at the two concavities of the substrate and connected by the circuit portion.

4 Claims, 4 Drawing Sheets

CERAMIC CHIP ANTENNA

BACKGROUND OF THE INVENTION

The present invention relates in general to a ceramic chip antenna, and more particularly, to a high efficiency, small-sized laminated ceramic antenna that is capable of improving radiating efficiency as well as being quickly and finely adjusted for applications in various different electronic products.

Electronic products such as mobile phones, personal digital assistants, globe positioning systems, and wireless local area networks transmit and receive signals by means of a small-sized antenna installed therein. The communication qualities of these electronic products are decided by the design and manufacture of their antennas. A good design and manufacture method of an antenna can ensure the electronic products an enhancement of their communication quality. Accordingly, persons skilled in the art have endeavored to perfect the chip antenna and various prior art patents are granted.

Taiwan patent number 543939 discloses a miniaturized thin plate type wireless transmission antenna that comprises a ceramic substrate on which an antenna conductor is formed.

Taiwan patent number 518801 discloses a chip antenna and manufacturing method of the same. The chip antenna comprises an antenna conductor, and a dielectric chip that stacks on a portion of the antenna conductor. An exposed portion of the antenna conductor, which is not overlapped on the dielectric chip, is bent along the surface of the dielectric chip in order to improve the bandwidth of the antenna.

Taiwan patent number 513827 discloses an antenna apparatus that comprises a substrate, a chip antenna mounted on the substrate, and a ground pattern disposed on the substrate, at least a portion on the side of a power supply terminal of an antenna conductor in the chip antenna being overlapped with the ground pattern.

Taiwan published application number 200414604 discloses a chip antenna that includes a substrate, a plurality of helical conductors provided on the substrate, and a pair of terminals provided on the substrate. The chip antenna alone is capable of transmitting and receiving electromagnetic waves of a plurality of frequencies.

However, accompanying their miniaturizations, all of aforementioned chip antennas have a low radiating efficiency. Besides, the manufacturing processes of aforementioned chip antennas are not flexible so that it is difficult to make modifications of aforementioned chip antennas for different applications. Furthermore, the laminated ceramics of aforementioned antennas are prone to contraction and deformation during their sintering processes, which greatly decreases the yield rates thereof.

BRIEF SUMMARY OF THE INVENTION

The present invention provides a small-sized ceramic chip antenna having a simple configuration so that the manufacturing processes thereof possess flexibility.

The ceramic chip antenna provided by the present invention is capable of improving radiating efficiency as well as being quickly and finely adjusted for applications in various different electronic products.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
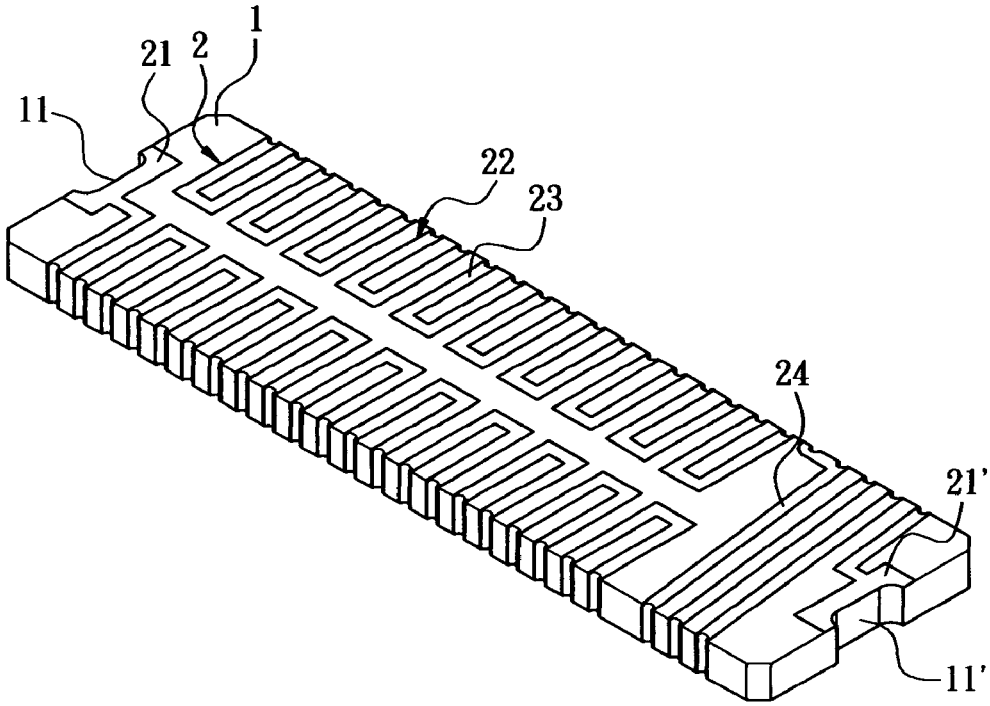
FIG. 1 is a schematic perspective view of an embodiment of a ceramic chip antenna of the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
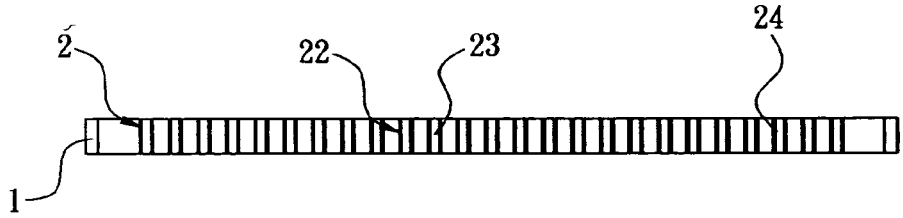
FIG. 2 is a schematic side view of the ceramic chip antenna shown in FIG. 1.
Figure 3:
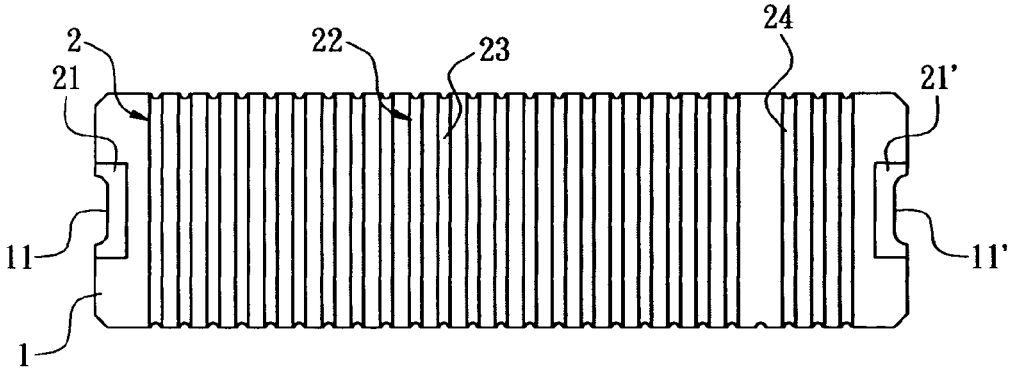
FIG. 3 is a schematic bottom view of the ceramic chip antenna shown in FIG. 1.

Referring to FIGS. 1 through 3, a ceramic chip antenna in accordance with the present invention includes a substrate 1 and a conductor 2 formed on surfaces of the substrate 1.

The substrate 1 is a thin plate of sintered ceramic material with a low dielectric loss and a high dielectric constant. The substrate 1 has a pair of concavities 11, 11' cut from both longitudinal ends thereof.

The conductor 2 is a metallic conductor with a high Q factor as well as a good anti-oxidization property. The conductor 2 is formed on surfaces of the substrate 1 by means of mask etching or printing technology, with two conducting electrodes 21, 21' disposed at the two concavities 11, 11'. The two conducting electrodes 21, 21' are connected by a circuit portion 22 that is formed on surfaces of the substrate 1 in a meandered or helical manner. The circuit portion 22 can be further divided into a radiation zone 23 and a feeding terminal 24.

The present invention is capable of remedying narrow bandwidth and low efficiency problems of conventional chip antennas, for the conductor 2 utilizes a high Q factor and good anti-oxidization metallic conductor, and is formed in a meandered and helical manner on surfaces of the substrate 1 that has a low dielectric loss and a high dielectric constant.

Altering the feeding terminal 24, for example, varying the line space width and the number of turns of the feeding terminal 24, can change the inductor volume thereof. Thus, the present invention can be quickly and finely adjusted for applications in various different electronic products.

Figure 4:
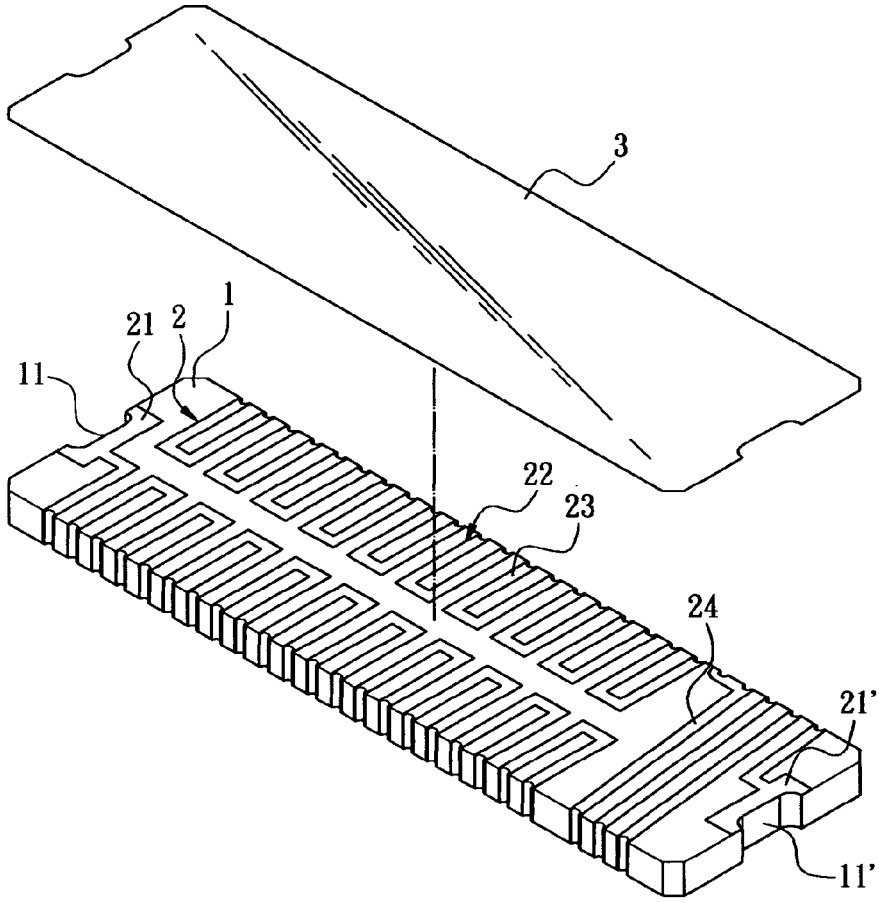
FIG. 4 is a schematic exploded view showing the ceramic chip antenna shown in FIG. 1 and a protective membrane that is utilized to envelop the substrate and the conductor.

Referring to FIG. 4, the present invention further comprises a protective membrane 3 enveloping the substrate 1 and the conductor 2. The protective membrane 3 is a dielectric membrane whose dielectric property and figure and size can be adjusted in order to modify the chip antenna's resonant frequency.

Figure 5:
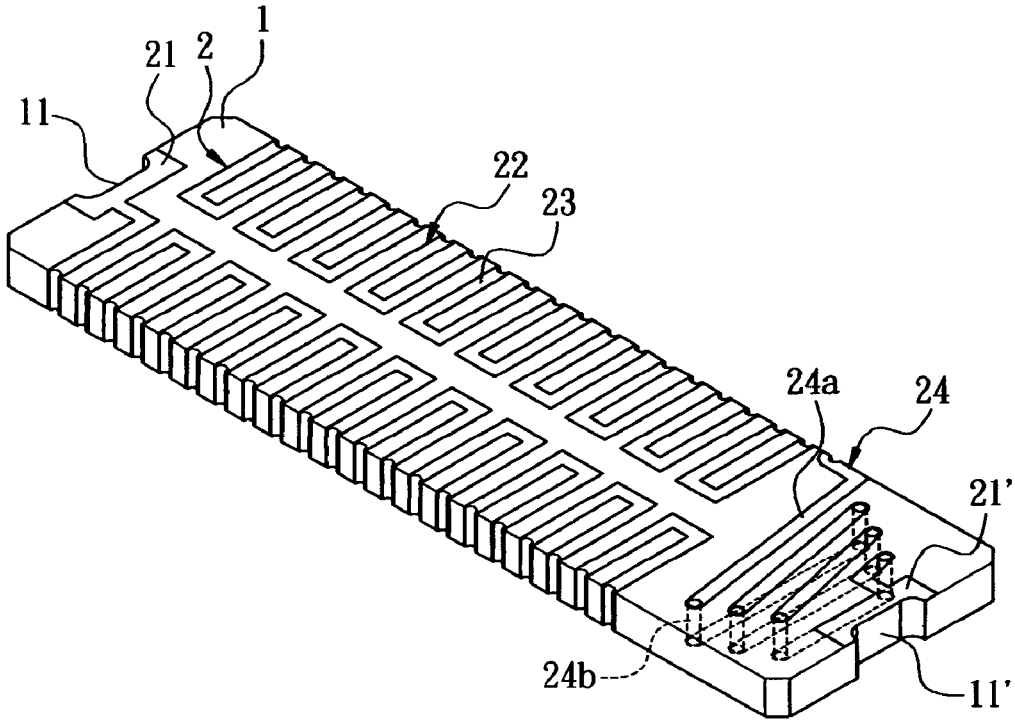
FIG. 5 is a schematic perspective view of another embodiment of a ceramic chip antenna of the present invention.

Referring to FIG. 5, another embodiment of a ceramic chip antenna in accordance with the present invention is shown. The feeding terminal 24 comprises a plurality of exposed portions 24*a* and a plurality of embedded portions 24*b*. Each embedded portion 24*b* penetrates through the substrate 1 and connects two exposed portions 24*a* that are formed on opposite surfaces of the substrate 1.

The exposed portions 24*a* can be either equally spaced or unequally spaced in order to modify the inductor volume of the feeding terminal 24. In addition, altering the number of turns of the feeding terminal 24 can change the inductor volume of the chip antenna. Thus, the inductor volume of the chip antenna can be modified and thereby satisfying the demands of different electronic products.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A ceramic chip antenna, comprising:

a substrate made of sintered ceramic material with a low dielectric loss and a high dielectric constant, having a pair of concavities cut from both longitudinal ends thereof; and a conductor having a circuit portion partially formed on surfaces of the substrate in a meandered or helical manner and partially embedded in the substrate, and two conducting electrodes disposed at the two concavities of the substrate and connected by the circuit portion wherein the circuit portion of the conductor includes a radiation zone and a feeding terminal having a plurality of exposed portions and a plurality of embedded portions, each embedded portion penetrating through the substrate and connecting two exposed portions that are formed on opposite surfaces of the substrate.

2. The ceramic chip antenna of claim 1, wherein the exposed portions can be either equally spaced or unequally spaced in order to modify the inductor volume of the feeding terminal.

3. The ceramic chip antenna of claim 1 further comprising a protective membrane enveloping the substrate and the conductor.

4. The ceramic chip antenna of claim 3, wherein the protective membrane is a dielectric membrane whose dielectric property and figure and size can be adjusted in order to modify the chip antenna's resonant frequency.

* * * * *